US008816236B2

(12) United States Patent
Pippin

(10) Patent No.: US 8,816,236 B2
(45) Date of Patent: Aug. 26, 2014

(54) MAIL HOLDER FOR USE IN A MAIL SORTING SYSTEM

(75) Inventor: James M. Pippin, Keller, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 1118 days.

(21) Appl. No.: 12/638,199

(22) Filed: Dec. 15, 2009

(65) Prior Publication Data

US 2010/0147751 A1 Jun. 17, 2010

Related U.S. Application Data

(60) Provisional application No. 61/122,460, filed on Dec. 15, 2008.

(51) Int. Cl.
*B07C 5/00* (2006.01)

(52) U.S. Cl.
USPC ..... 209/583; 209/584

(58) Field of Classification Search
USPC ..... 209/583
See application file for complete search history.

(56) References Cited

U.S. PATENT DOCUMENTS 1,698,841 A * 1/1929 Doughty ..... 229/72
1,745,249 A * 1/1930 Doughty ..... 229/67.3
1,956,325 A * 4/1934 Hart ..... 229/67.3
RE20,081 E * 8/1936 White ..... 229/72
2,066,897 A * 1/1937 Olm ..... 156/222
2,186,302 A * 1/1940 Martin ..... 62/380
2,710,240 A * 6/1955 Berg ..... 312/134
2,810,652 A * 10/1957 Armbruster ..... 53/408
2,873,159 A * 2/1959 Becker ..... 312/319.7
3,023,947 A * 3/1962 McDuffie ..... 383/109
3,028,612 A * 4/1962 Sindell ..... 114/354
3,297,378 A * 1/1967 Krug et al. ..... 312/268
3,391,698 A * 7/1968 Wiles ..... 220/500
3,517,606 A * 6/1970 Myles et al. ..... 452/194
3,531,171 A * 9/1970 Raabe et al. ..... 312/268
3,573,748 A * 4/1971 Holme ..... 209/584
3,642,338 A * 2/1972 Humphrey ..... 312/184
3,674,160 A * 7/1972 Gutowski ..... 414/220
3,721,435 A * 3/1973 Zanders ..... 271/293
3,810,809 A * 5/1974 Herd et al. ..... 156/468

(Continued)

OTHER PUBLICATIONS

Websters II New University Rivendale Dictionary, 1988 p. 1016.*

*Primary Examiner* — Stefanos Karmis
*Assistant Examiner* — Michael E Butler

(57) ABSTRACT

A holder for flat objects according the invention includes an endless belt made of a flexible sheet material, wherein an end portion of the belt is folded into itself forming an inner bend and an outer bend with the inner bend disposed inside of the outer bend. A set of first and second support rods are disposed side by side in parallel to each other, the first rod at the bottom of the inner bend and the second rod at the bottom of the outer bend. A pair of third and fourth rods extend through parallel endwise openings in the belt between the inner and outer bends, which third and fourth rods are disposed side by side in parallel to each other with the belt is wound over the third and fourth rods so that the belt can slide over the third and fourth rods, whereby movement of the first rod away from the second rod causes sliding movement of the belt over the third and fourth rods. In a preferred embodiment an inside surface of the belt is attached to one or both of the first and second rods.

8 Claims, 5 Drawing Sheets

(56) References Cited

U.S. PATENT DOCUMENTS

| | | | | | |
|---|---|---|---|---|---|
| 4,008,813 | A | * | 2/1977 | Leersnijder | 414/265 |
| 4,082,216 | A | * | 4/1978 | Clarke | 229/164.1 |
| 4,157,103 | A | * | 6/1979 | La Fleur | 141/98 |
| 4,223,939 | A | * | 9/1980 | Beggs | 296/26.11 |
| 4,232,596 | A | * | 11/1980 | Kroll et al. | 99/410 |
| 4,312,550 | A | * | 1/1982 | Jackson | 312/268 |
| 4,332,377 | A | * | 6/1982 | DuBois et al. | 271/293 |
| 4,433,837 | A | * | 2/1984 | Romanowski | 271/293 |
| 4,507,739 | A | * | 3/1985 | Haruki et al. | 700/224 |
| 4,542,832 | A | * | 9/1985 | Minick et al. | 211/106 |
| 4,549,729 | A | * | 10/1985 | Hoffstetter et al. | 270/39.07 |
| 4,772,009 | A | * | 9/1988 | Jacobs | 271/293 |
| 4,830,268 | A | * | 5/1989 | Pitts | 229/67.1 |
| 5,025,979 | A | * | 6/1991 | Dellacroce | 229/67.2 |
| 5,064,069 | A | * | 11/1991 | Su | 206/425 |
| 5,086,947 | A | * | 2/1992 | Bragaglia | 221/72 |
| 5,086,974 | A | * | 2/1992 | Henshaw | 239/101 |
| 5,207,781 | A | * | 5/1993 | Rock | 312/319.1 |
| 5,238,116 | A | * | 8/1993 | Santicchi | 209/3.3 |
| 5,252,161 | A | * | 10/1993 | Chang et al. | 156/196 |
| 5,256,130 | A | * | 10/1993 | Kachel et al. | 493/210 |
| 5,324,025 | A | * | 6/1994 | Chadwick et al. | 271/306 |
| 5,354,242 | A | * | 10/1994 | St. John | 474/135 |
| 5,522,344 | A | * | 6/1996 | Demurjian | 119/474 |
| 5,586,642 | A | * | 12/1996 | Hawkins | 198/803.11 |
| 5,667,211 | A | * | 9/1997 | Reist | 270/52.16 |
| 5,669,331 | A | * | 9/1997 | Richmond | 119/497 |
| 5,740,900 | A | * | 4/1998 | Cote et al. | 198/436 |
| 5,819,622 | A | * | 10/1998 | Quick | 83/365 |
| 5,913,448 | A | * | 6/1999 | Mann et al. | 220/666 |
| 5,915,722 | A | * | 6/1999 | Thrasher et al. | 280/649 |
| 5,960,883 | A | * | 10/1999 | Tubel et al. | 166/313 |
| 6,203,000 | B1 | * | 3/2001 | Hill | 270/58.11 |
| 6,227,378 | B1 | * | 5/2001 | Jones et al. | 209/698 |
| 6,234,677 | B1 | * | 5/2001 | Mogil | 383/110 |
| 6,308,497 | B1 | * | 10/2001 | Cassoli et al. | 53/228 |
| 6,311,968 | B1 | * | 11/2001 | Linder et al. | 270/52.25 |
| 6,431,357 | B1 | * | 8/2002 | Su | 206/425 |
| 6,431,406 | B1 | * | 8/2002 | Pruett | 222/210 |
| 6,505,755 | B1 | * | 1/2003 | Voss | 221/192 |
| 6,516,927 | B2 | * | 2/2003 | Krulik | 190/114 |
| 7,025,019 | B2 | * | 4/2006 | Axelrod et al. | 119/499 |
| 7,111,742 | B1 | * | 9/2006 | Zimmermann | 209/665 |
| 7,225,741 | B2 | * | 6/2007 | Huffman | 102/434 |
| 7,225,841 | B2 | * | 6/2007 | Folk | 141/114 |
| 7,325,684 | B1 | * | 2/2008 | Ramos | 206/425 |
| 7,370,765 | B1 | * | 5/2008 | Ellenberger et al. | 209/644 |
| 8,013,267 | B2 | * | 9/2011 | Stemmle | 209/584 |
| 8,230,141 | B2 | * | 7/2012 | Zimmermann | 710/53 |
| 2002/0014429 | A1 | * | 2/2002 | Johnson | 206/425 |
| 2002/0039943 | A1 | * | 4/2002 | Serkh | 474/134 |
| 2003/0038065 | A1 | * | 2/2003 | Pippin et al. | 209/584 |
| 2003/0121236 | A1 | * | 7/2003 | Middelberg et al. | 53/460 |
| 2004/0007544 | A1 | * | 1/2004 | MacKelvie | 211/40 |
| 2006/0237518 | A1 | * | 10/2006 | Hageneder | 229/67.1 |
| 2007/0017855 | A1 | * | 1/2007 | Pippin | 209/584 |
| 2007/0033996 | A1 | * | 2/2007 | Simperl et al. | 73/117.3 |
| 2007/0209976 | A1 | * | 9/2007 | Worth et al. | 209/584 |
| 2008/0012211 | A1 | * | 1/2008 | Stemmle | 271/204 |
| 2008/0093273 | A1 | * | 4/2008 | Stemmle | 209/584 |
| 2008/0116628 | A1 | * | 5/2008 | Edwards et al. | 271/186 |
| 2010/0139221 | A1 | * | 6/2010 | Gaug et al. | 53/473 |
| 2010/0194025 | A1 | * | 8/2010 | Kalm | 271/2 |

* cited by examiner

MAIL HOLDER FOR USE IN A MAIL SORTING SYSTEM

This application claims priority of U.S. provisional application No. 61/122,460 filed Dec. 15, 2008.

BACKGROUND OF THE INVENTION

Several prior patents and patent applications describe the use of an H-shaped belt as part of a mail holder and capable of ejecting the mail pieces from the open end of the holder. See U.S. Pat. No. 7,547,174 Method of Removing a Flat Article from a Holder and U.S. Pat. No. 7,138,596 Apparatus and Method for Mail Sorting, and U.S. Patent Publications 20070209976 and 20070017855 (Mail Sorting System).

The H-belt was used as part of an ejection mechanism in a sorting robot which delivers a mail piece to a slot in a sorting case and then ejects a carrier flat mail piece into the slot. It has been further proposed to sort mail pieces by first placing them into holders such as folders and sorting the folders.

U.S. Patent Publication No. 20070209976 describes a single pass mail sorting system wherein flat mail pieces are inserted into holders in the form of folders or bags doubled over a support rail, and the holders are sorted in order to sort the mail pieces contained inside. A holder of the present invention differs from the known H-belt holder in that it does not eject the mail piece in the sense of pushing it out of the holder; rather it withdraws the holder walls around it, leaving the mail piece exposed for removal.

SUMMARY OF THE INVENTION

A holder for flat objects according to the invention includes an endless belt made of a flexible sheet material, wherein an end portion of the belt is folded into itself forming an inner bend and an outer bend with the inner bend disposed inside of the outer bend. A set of first and second support rods are disposed side by side in parallel to each other, the first rod at the bottom of the inner bend and the second rod at the bottom of the outer bend. A pair of third and fourth rods extend through parallel endwise openings in the belt between the inner and outer bends, which third and fourth rods are disposed side by side in parallel to each other with the belt is wound over the third and fourth rods so that the belt can slide over the third and fourth rods, whereby movement of the first rod away from the second rod causes sliding movement of the belt over the third and fourth rods. In a preferred embodiment an inside surface of the belt is attached to one or both of the first and second rods.

A holder mechanism according to the invention refers to the holder in its deployed form. Such a mechanism further comprises a first fixture securing one of the first and second rods against movement, for example the first rod is immovably attached to the first fixture. A second fixture is provided to which the third and forth rods are attached by a connector for movement towards and away from the second fixture. Preferably the connector comprises a spring which biases the third and fourth rods to a position near the second fixture and applies a return force when the third and fourth rods move away from the second fixture in response to movement of the second rod away from the first rod. In another embodiment a clamp biases the third and fourth rods toward one another and clamps the belt between the third and fourth rods. This helps prevent slipping of the held flat mail piece.

According to another aspect of the invention a mail handling system includes a plurality of holders configured for receiving and holding mail pieces therein, each holder having a pocket for receiving a mail piece therein and a built in release mechanism whereby actuation of the release mechanism causes removal of a held mail piece from the pocket, each holder further having a pair of hanger portions by which the holder can be suspended at opposite sides in a position for removal of a held mail piece from the pocket by actuation of the built in release mechanism; and the invention further provides a flat mail piece holder for use with an extraction device which actuates the built in release mechanism of multiple holders simultaneously. Simultaneous removal of a group of holder belts separating adjacent items occurs without relative motion between the items and the group of holder belts. Such motion is cancelled by the peeling away of the belts from the surfaces of the mail pieces.

For purposes of the present invention the word "fixed" indicates a part that cannot move to any significant extent toward or away the surface it is mounted on, whereas "secured" refers to a part that is attached to another part such that it is capable of movement toward or away from the other part over a limited range. A "fixture" means a part on which other parts can be mounted wither fixedly or for limited movement. The springs described hereafter are attached to a fixture but can move (extend and contract relative to the fixture.) A part described as fixed need not be absolutely rigid and may be free to pivot relative to the part it is fixed to, but incapable of moving linearly toward and away from it. These and other aspects of the invention are discussed further in the detailed description that follows.

DETAILED DESCRIPTION

Figure 1:
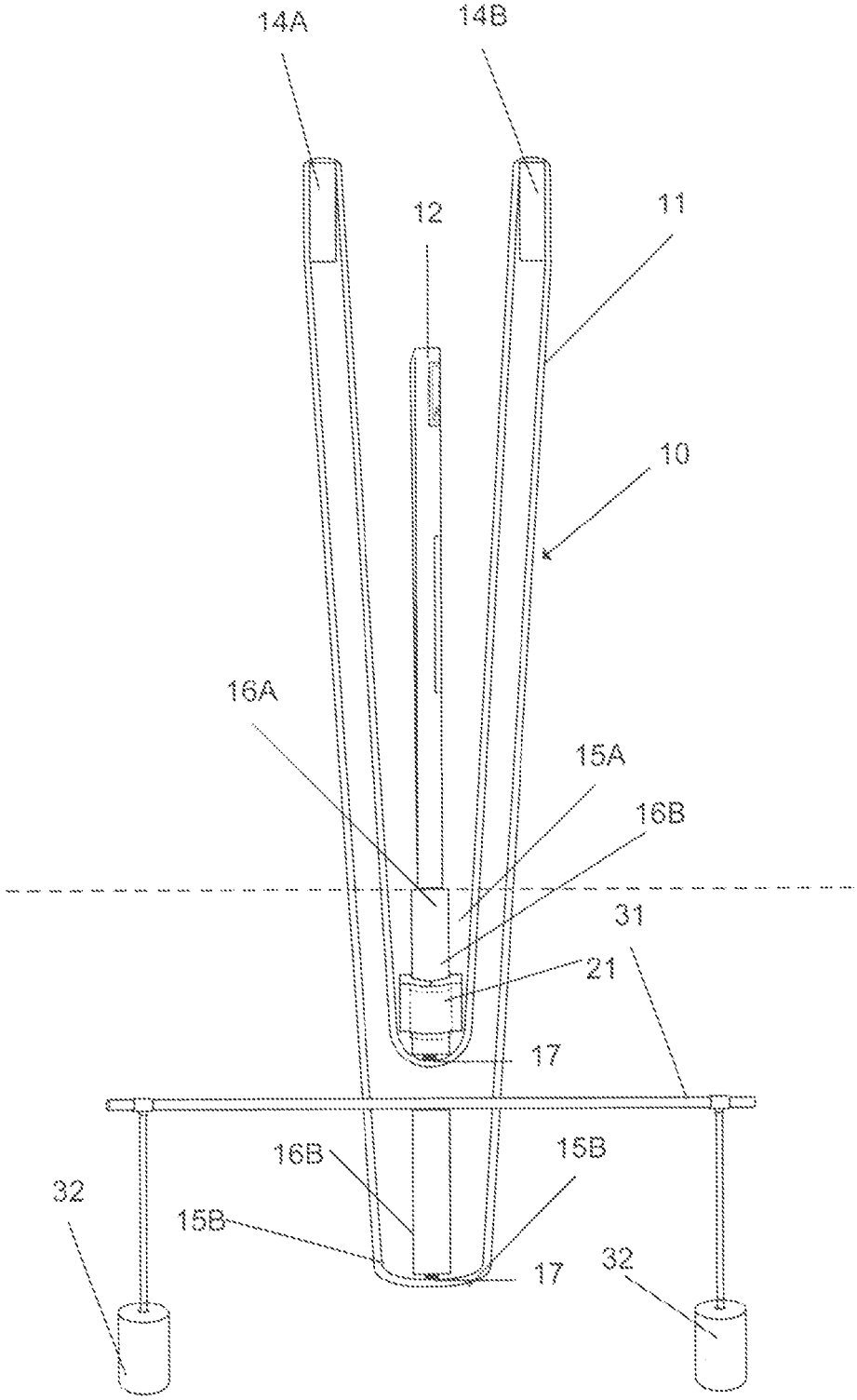
FIG. 1 is an end view of the holder of the invention holding a mail piece.
Figure 2:
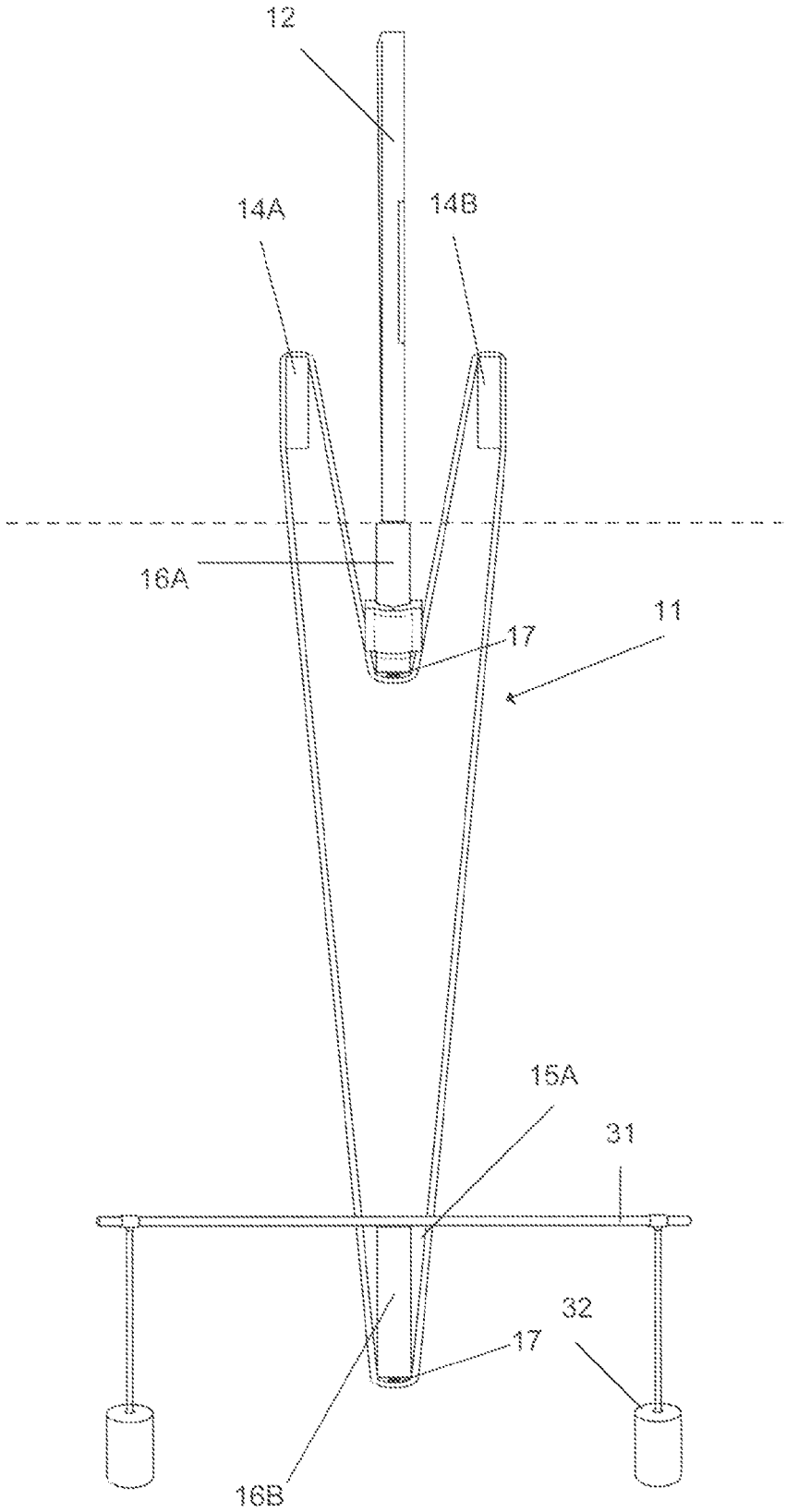
FIG. 2 is an end view of the holder of FIG. 1 in position for removal of a mail piece.
Figure 3:
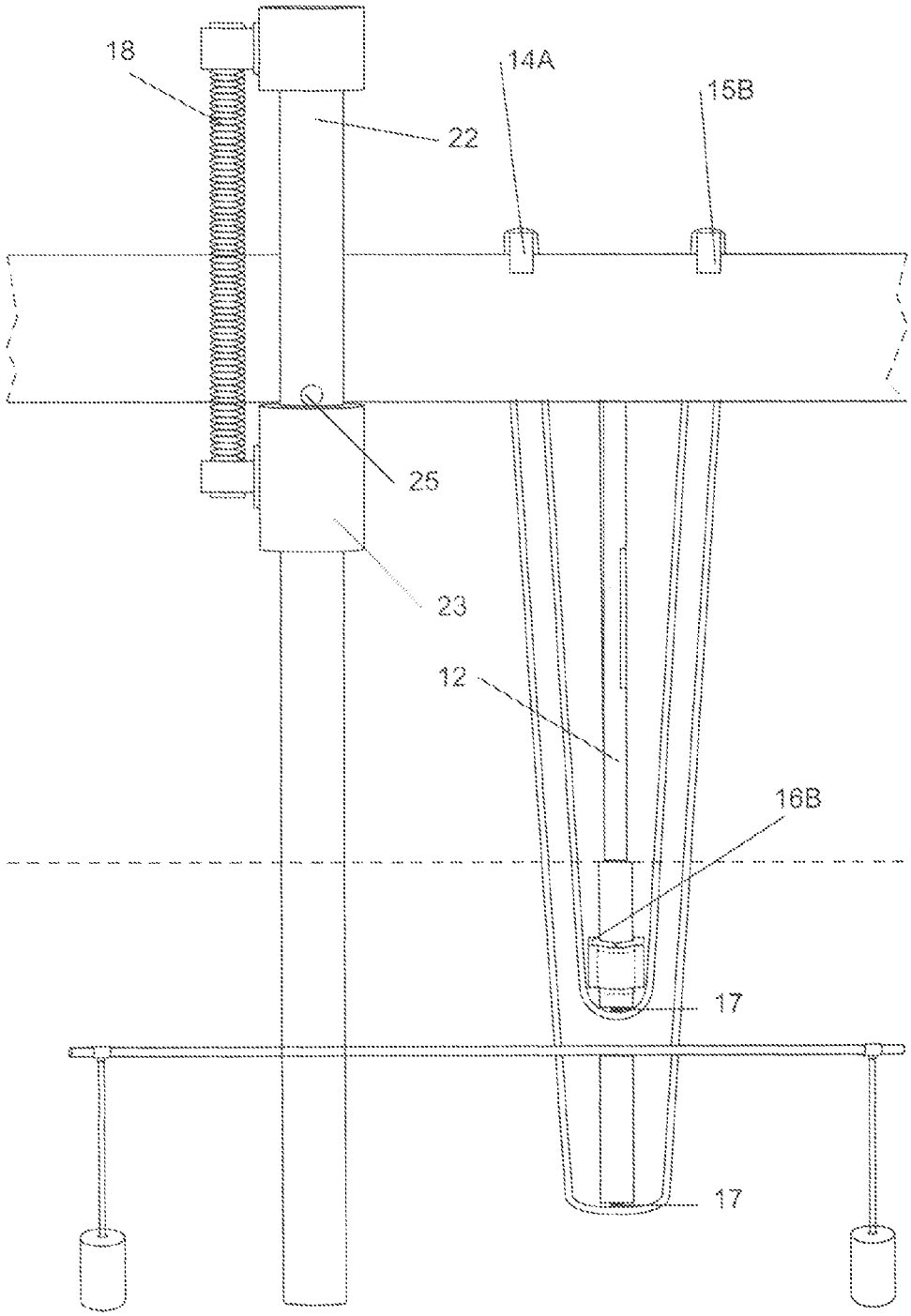
FIG. 3 is an end view of the holder of FIG. 2.

Referring to FIGS. 1-3, a holder 10 includes an endless belt 11 is used to hold a flat mail piece or similar item 12. Flat items 12 are preferred but the holder 10 can be configured to hold three dimensional (non-flat) items as well. Endless belt 11 is made of a flexible sheet material. An end portion of the belt 11 is folded into itself forming an inner bend or pocket 15A and an outer bend or pocket 15B with the inner bend 15A disposed inside of the outer bend or pocket 15B. A pair of first and second support rods 16A and 16B are disposed side by side in parallel to each other. Rod 16A extends linearly along the bottom of inner bend 15A, and Rod 16B extends linearly along at the bottom of outer bend 15B. In a preferred form of the invention one of rods 16A, or 16B are attached to the bottoms of bends 15A, 15B, respectively by seams, glue or similar means of attachment 17. Attachment 17 preferably extends along the entire length of rod 16A or 6B for the entire width of belt 11 at that location.

One of rods 16 is free to move whereas the other is fixed. In this example the bottom rod 16B is free to move and rod 16A at the bottom of inner bend 15A is fixed (held) by a releasable automated clamp 21 that is mounted on an adjoining surface. Belt 11 is secured as described above to the movable rod 16B.

A pair of third and fourth rods 14A and 14B are positioned side by side and extend in parallel to each other through endwise openings in the top of belt 11, namely at the upper end of outer bend 15B. Rods 14A, 14B and 16A and 16B are parallel and oriented horizontally in this example. Belt 11 is wound over central portions of rods 14A and 14B so that the belt can slide over rods 14A, 14B in response to movement of rods 16 as described hereafter.

End portions 19A and 19B of rods 14A, 14B are C-shaped forming downwardly opening notches 20 at opposite ends of each rod. At notches 20 opposite ends of rods 14A and 14B are mounted on a pair of spaced rails 42.

Rod 16A is fixed by any suitable means, such as an automated clamp 21 which releasably grasps a free end of rod 16A. Movement of the rod 16B downward, i.e. away from the fixed rod 16A, causes sliding movement of the belt 11 over the third and fourth rods 14A and 14B, moving from the position of FIG. 1 to the position of FIG. 2. Relative motion of rod 16B to rods 14A and 14B has the effect of drawing rods 14A, 14B downwardly in the embodiment shown. The resulting shortening of inner bend 15A peels belt 11 away from the surface of mail piece 12.

To actuate rod 16B, i.e. move it downwardly/away from fixed rod 16A, an effector bar 31 is mounted extending horizontally from the end of the shaft of a solenoid or other linear motion device e.g. a pair of solenoids 32 oriented vertically, perpendicular to bar 31. Bar 31 is above and perpendicular to the upper edge of rod 16B. Solenoids 32 draw bar 31 and thereby rod 16B down when actuated, and when solenoids 32 are de-energized, a spring or pair of springs 18 return rod 16B to its starting position. Preferably a pair of solenoids 32 are positioned to cause bar 31 to engage rod 16B at opposite ends. Spring 18 is fixed at one end to a post 22, e.g. at its upper end, and the other end of spring 18 is attached to a slider 23 which is mounted on post 22 below its upper end. Slider 23 has a lateral extension or lip 24 which extends under the adjacent rail 42 and supports it. A stop pin 25 extends radially to limit upward travel of slider 23 past an uppermost position at which rail 42 is in its raised starting position.

Preferably the spring and post assembly is duplicated near opposite ends of rail 42 so that a symmetrical return force is provided to rail 42. Further, since a pair of rails 42 are provided to mount opposite ends of rods 14A and 14B, it is likewise necessary to provide a spring and post assembly on the outside rail 42 opposite inside rail 42 shown in FIG. 3. For each holder or group of holders 10 there is preferably at least four spring and post assemblies positioned in pairs as described above.

Once all of the holders have assumed the position of FIG. 2, mail pieces 11 are removed in a manual or automated sweeping step.

To remove holder 10 for reloading, clamp 21 is opened, releasing rod 16A. Another holder 10 is then put into position for opening (extraction) and clamp 21 is re-engaged with the rod 16A of that holder 10. Notches 20 of the next holder 10 are placed onto rails 42.

For purposes of automation, springs 18 may be replaced by solenoids or 2-way cylinders such that rods 14A, 14B can move down during extraction and then are pulled up when returning holder 10 to its starting position.

Figure 4:
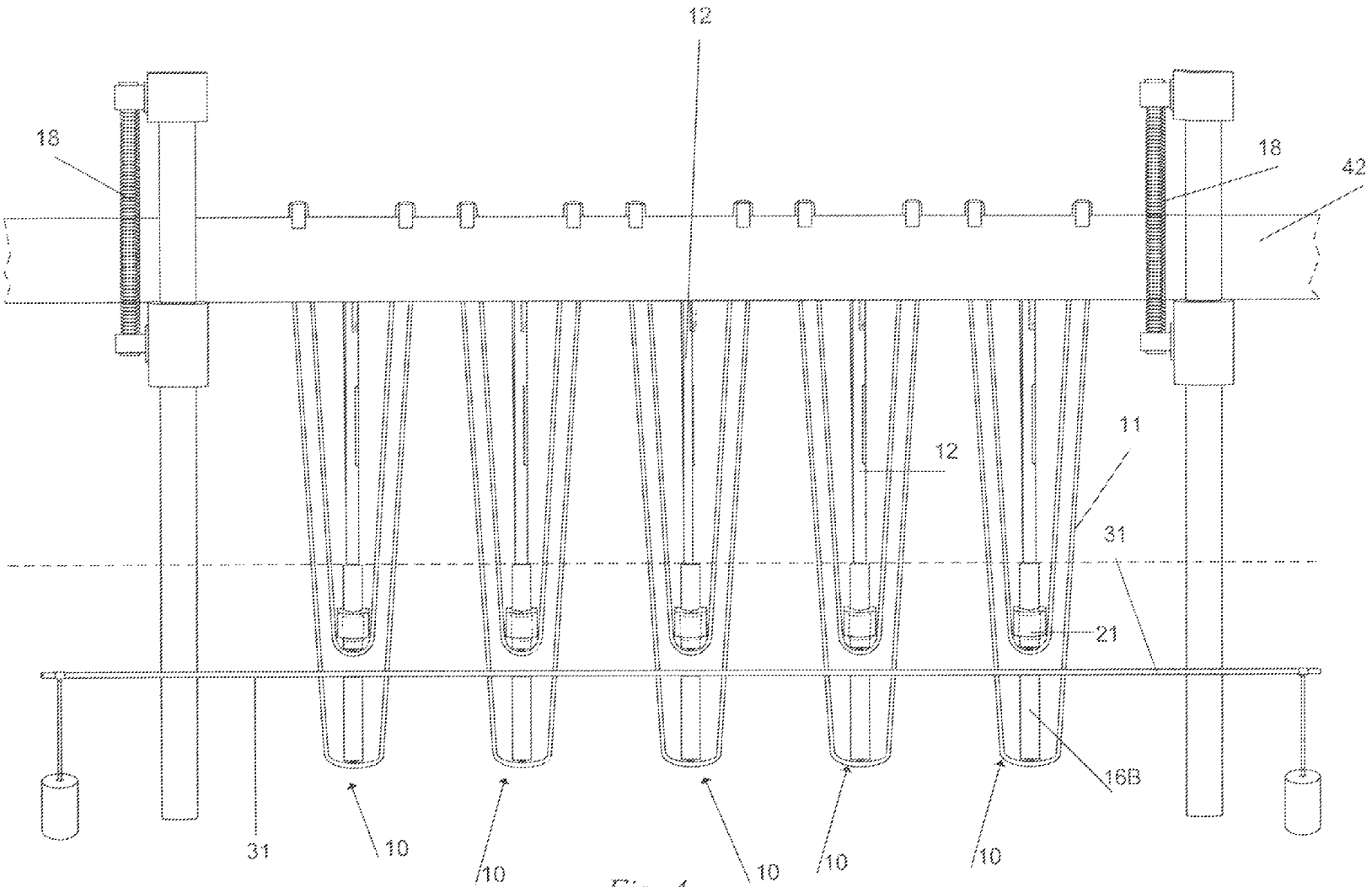
FIG. 4 is an end view of a row of holders as shown in FIGS. 2 and 3 positioned for mass extraction.
Figure 5:
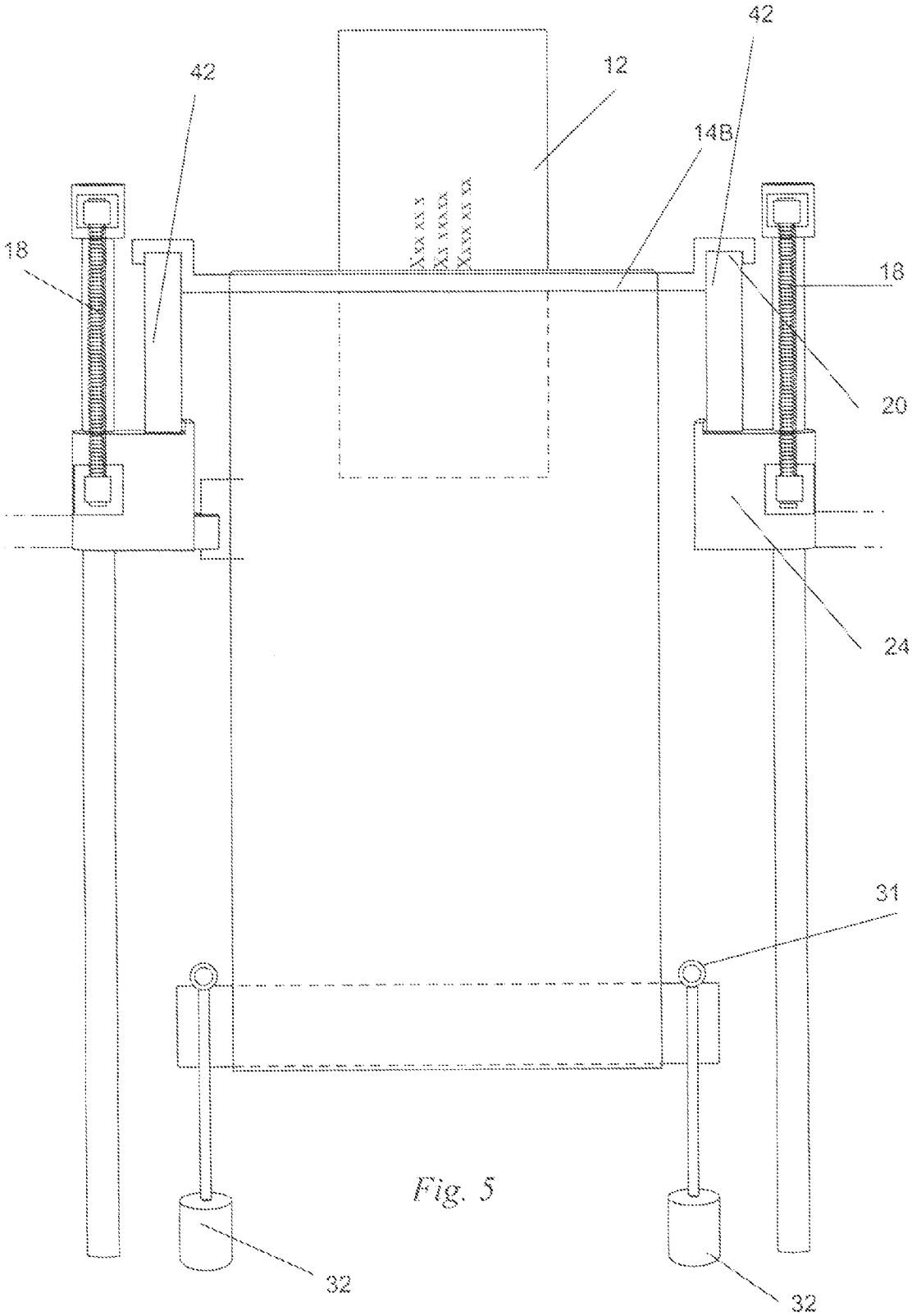
FIG. 5 is a front view of a rod of the invention mounted on a rail.

A single bar 31 can actuate all of a series of holders 10 mounted on a pair of rails 42 as shown in FIG. 4, thereby enabling mass extraction. As a series of holders are opened at the same time, all of the unloaded mail pieces 12 can be swept (manually or robotically) into a waiting tray or other container. Mass extraction is needed for any sorting system that uses holders 10 to sort mail, such as the one described in U.S. Ser. No. 11/716,200, filed Mar. 9, 2007, the contents of which are incorporated by reference herein.

FIG. 6 illustrates an improved form of holder 10 wherein rods 14A and 14B are united at opposite ends by a clamp that causes biases rods 14A and 14B towards each other. In the embodiment shown, rods 14A and 14B have U-shaped end portions 34 that form notches 20. A living hinge 36 connects 14A and 14B at both ends of rods 14 and 14B. Hinges 36 are made of a resilient material such as spring steel and are offset laterally from where the belt 11 is wound over the rods 14A, B. Hinge 36 thus causes rods 14A, B to exert a light clamping force on mail piece 12 for the purpose of preventing mail piece 12 from coming loose from holder 10 other than as part of the mail piece removal step. Instead of the living hinges shown, it is also possible to provide springs between rods 14A, B at their ends, or apply a spring-loaded clamp to the ends.

The invention permits a number of alternative constructions. It is preferred but not essential for the belt 11 to be physically attached to the rods 16A, 16B, but without at least one such attachment the movement of the belt 11 can become unstable and thin mail could move between belt surfaces and become caught. The holder of the invention could however be used without such attachments (which restrict pocket size) to hold three-dimensional objects such as luggage in an airline baggage transport system. It will thus be understood that the foregoing description is of preferred exemplary embodiments of the invention, and that the invention is not limited to the specific forms shown. Modifications may be made in without departing from the scope of the invention as expressed in the appended claims.

The invention claimed is:

1. A holder for flat objects, comprising:

an endless belt made of a flexible sheet material, wherein an end portion of the belt is folded into itself forming an inner bend and an outer bend with the inner bend disposed inside of the outer bend;

a set of first and second support rods which rods are disposed side by side in parallel to each other, the first rod at the bottom of the inner bend and the second rod at the bottom of the outer bend, with one of the first and second rods secured in a fixed position; and a pair of third and fourth rods extending through parallel endwise openings in the belt between the inner and outer bends, which third and fourth rods are disposed side by side in parallel to each other with the belt wound over the third and fourth rods so that the belt can slide over the third and fourth rods, whereby movement of the first rod away from the second rod causes sliding movement of the belt over the third and fourth rods to expose a mail piece disposed within the inner bend.

2. The holder of claim 1, further comprising a first fixture securing one of the first and second rods in the fixed position.

3. The holder of claim 2, wherein an inside surface of the belt is attached to one of the first and second rods.

4. The holder of claim 3, wherein an inside surface of the belt is attached to both of the first and second rods at the bottoms of the inner and outer bends.

5. The holder of claim 2, wherein the first rod is immovably attached to the first fixture.

6. The holder of claim 1, further comprising a second fixture to which the third and fourth rods are attached by a connector for movement towards and away from the second fixture.

7. The holder of claim 6, wherein the connector comprises a spring which biases the third and fourth rods to a position near the second fixture and applies a return force when the third and fourth rods move away from the second fixture in response to movement of the second rod away from the first rod.

8. The holder of claim 1, further comprising means for biasing the third and fourth rods toward one another that clamps the belt between the third and fourth rods.

* * * * *